United States Patent [19]

Woolard

[11] 4,364,371

[45] Dec. 21, 1982

[54] HAND HELD BALL THROWING IMPLEMENT

[76] Inventor: Joseph H. Woolard, 1040 Charity Dr., Virginia Beach, Va. 23455

[21] Appl. No.: 222,474

[22] Filed: Jan. 5, 1981

[51] Int. Cl.[3] ..... F41B 3/00

[52] U.S. Cl. ..... 124/5; 124/41 R

[58] Field of Search ..... 124/5, 41 R, 80, 4, 124/1

[56] References Cited

U.S. PATENT DOCUMENTS

| | | | |
|---|---|---|---|
| 1,168,808 | 1/1916 | von Hoffman | 124/5 |
| 1,905,932 | 4/1933 | Foster . | |
| 1,914,449 | 1/1934 | Murray . | |
| 2,705,148 | 3/1955 | Waller | 273/106 |
| 2,902,023 | 9/1959 | Waller | 124/5 |
| 3,557,768 | 1/1971 | Lake | 124/5 |
| 3,841,292 | 10/1974 | Hoffman | 124/5 |
| 3,897,068 | 7/1929 | Staples | 273/186 A |

FOREIGN PATENT DOCUMENTS

| | | | |
|---|---|---|---|
| 665117 | 4/1929 | France | 124/5 |

*Primary Examiner*—Richard C. Pinkham
*Assistant Examiner*—William R. Browne
*Attorney, Agent, or Firm*—Pollock, Vande Sande & Priddy

[57] ABSTRACT

A ball throwing implement (10) is disclosed which includes a flexible shaft (12) having at one end a threaded portion (16) on which a stop disk (18) is movably mounted. A ball or similar game element (20) having a diametral bore (22) is slipped over the end of the flexible shaft into position against the stop disk. On the other side of the ball from the stop disk, a resilient release element is incorporated in the shaft so that it bears against the wall of the diametral bore. By moving the stop disk to adjust the extent of engagement of the diametral bore with the release element, the force required to throw the ball from the shaft may be adjusted.

4 Claims, 5 Drawing Figures

HAND HELD BALL THROWING IMPLEMENT

DESCRIPTION

1. Technical Field

This invention relates to implements for throwing game elements such as balls. Specifically, the invention concerns a ball throwing implement of the type in which a ball having a diametral bore is slipped over one end of a flexible shaft and thrown by swinging the shaft along an arc until the ball slides off.

2. Background Art

Ball throwing implements have been known for some time, such as those shown in U.S. Pat. Nos. 1,168,808 granted to Von Hoffmann and 3,897,068 granted to Staples; and in French Pat. No. 665,117 granted to Coutant. While such implements each have their own particular advantages, they all suffer from the disadvantage that it is difficult to adjust easily the force which is required to throw the ball from the implement. Depending upon the type of game which is played using the implement and the skill of the user, a need for such adjustability has existed for quite some time.

DISCLOSURE OF THE INVENTION

The object of the present invention is to provide an improved implement for throwing a game element such as a ball which includes means for adjusting the force required to cause the ball to fly or slide from the implement.

This object of the invention is given only by way of example; thus, other desirable objectives and advantages inherently achieved by the disclosed structure may occur to those skilled in the art. Nonetheless, the scope of the invention is to be limited only by the appended claims.

In the preferred embodiment of the invention, the implement comprises a flexible shaft of straight or tapered configuration, made from any suitable material such as metal, bamboo, plastic and the like. At one end of the shaft a suitable grip is provided; and at the other end, a movable stop. The stop preferably comprises a disk having a threaded bore which coacts with a threaded portion of the shaft near its other end. Beyond the threaded portion of the shaft are located a pair of axially extending indentations in the shaft which are bridged by a pair of resilient stop elements such as leaf or bowed wire springs. A ball or similar game element having a diametral bore is forced past the springs into contact with the stop disk. By adjusting the position of the ball so that it engages more or less of the stop elements, one may adjust the force required to propel the ball from the shaft.

BEST MODE FOR CARRYING OUT THE INVENTION

Figure 1:
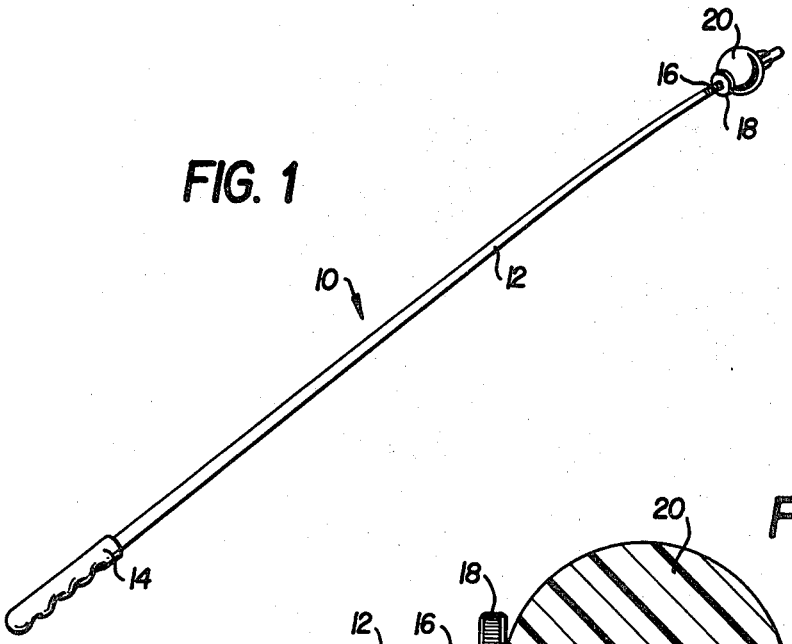
FIG. 1 shows a perspective view of a ball throwing implement according to the invention.

The following is a detailed description of a preferred embodiment of the invention, reference being made to the drawing in which like reference numerals identify like elements of structure in each of the several Figures.

Figure 2:
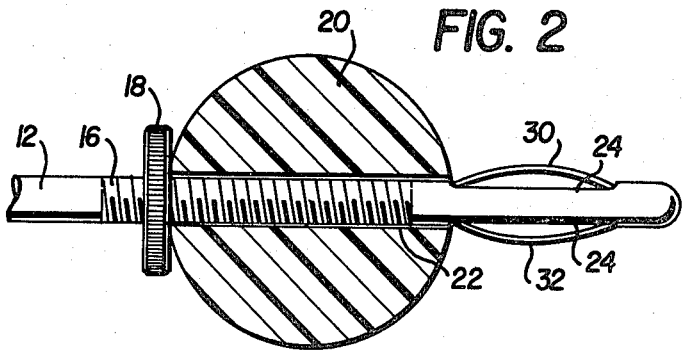
FIG. 2 shows an enlarged, partially sectioned side view of the outer end of the implement of FIG. 1.
Figure 3:
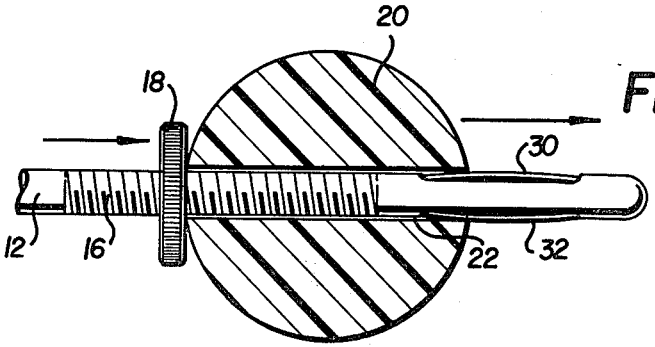
FIG. 3 shows the structure of FIG. 2 in which the ball has been moved part way into engagement with the retaining springs.
Figure 4:
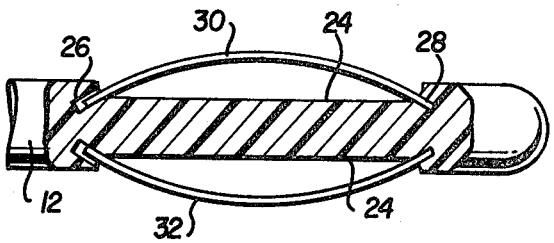
FIG. 4 shows an enlarged view of the end of the shaft of the implement indicating the mode of attachment of the retaining springs.
Figure 5:
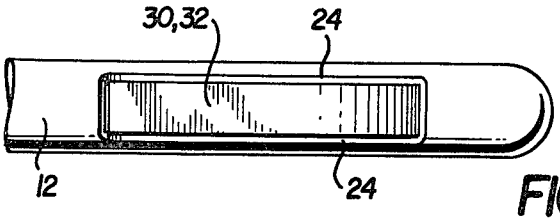
FIG. 5 shows a top view of the structure illustrated in FIG. 4.

Referring simultaneously to FIGS. 1 to 5, the structure and function of the ball-throwing implement according to the invention may be understood. The implement 10 comprises a flexible shaft 12 of suitable material provided at one end with a hand-grip 14. At the other end of shaft 12, a threaded portion 16 is provided, beginning at a distance from the end of shaft 12 which is approximately equal to the diameter of the ball to be thrown using the implement. A stop disk 18 having a threaded central bore is mounted on threaded portion 16 in position to contact a ball 20 at one end of a diametral bore 22 passing through the ball. Bore 22 may be provided with a wear resistant liner (not illustrated) or with liners having various coefficients of friction. Between threaded portion 16 and the end of shaft 12 are located at least a pair of axially extending indentations 24 having receptor pockets or bores 26, 28 at the opposite ends thereof. A pair of flat leaf springs 30, 32 is mounted within bores 26, 28 so that the springs are bowed radially outwardly from the outer diameter of shaft 12 in position to contact the wall of diametral bore 22 as ball 20 moves along the shaft. Although flat, leaf springs are illustrated, those skilled in the art will appreciate that bowed, round wire springs could also be used. As illustrated, bores 26 may be enlarged to permit one end of springs 30, 32 to move in and out as the springs flex. Also, the springs could be anchored only at bores 26 and free at their other ends; however, this would require manual compression of the springs before ball 20 could be slipped past them into contact with stop disk 18.

In use, the ball 20 is slipped over the end of shaft 12 and into contact with stop disk 18. The position of disk 18 along threaded portion 16 is then adjusted so that the degree of compression of springs 30, 32 is varied. The user then holds the implement by grip 14 while springs 30, 32 prevent ball 20 from simply dropping from the end of shaft 12. By swinging the implement along an arc, the user will eventually bring the implement to a position in which centrifugal force will cause ball 20 to fly from the implement.

INDUSTRIAL APPLICABILITY

The present invention is particularly suited for use as a ball throwing implement in a variety of ball games such as variations of golf, target games and the like.

Having described my invention in sufficient detail to enable those skilled in the art to make and use it,

I claim:

1. An improved ball throwing implement, comprising:

an elongated, flexible shaft having a grip end;

radially extending resilient means positioned near the opposite end of said shaft for frictionally engaging the wall of a diametral bore provided in a game element to be thrown by said implement; and axially adjustable stop means positioned adjacent said resilient means for adjusting the extent of engagement of a diametral bore in a game element with said resilient means, whereby the force required to throw a game element from the implement can be selectively varied.

2. An implement according to claim 1, wherein said stop means comprises a disk having a threaded central bore and a threaded portion of said flexible shaft.

3. An implement according to claim 1, wherein said resilient means comprises a pair of axially extending indentations on said shaft and a corresponding pair of elongated spring elements extending from one end of said indentations to the other.

4. An implement according to claim 3, wherein said spring elements are attached to said shaft at the outer ends thereof and are free to move within bores provided in said shaft at the inner ends thereof.

* * * * *